US005535474A

United States Patent [19]

Salazar

[11] Patent Number: 5,535,474

[45] Date of Patent: Jul. 16, 1996

[54] BRUSH FOR CLEANING AND POLISHING TEETH WHILE STIMULATING GUMS

[76] Inventor: Alfred Salazar, 17406 S. 92nd East Ave., Bixby, Okla. 74008

[21] Appl. No.: 409,149

[22] Filed: Mar. 23, 1995

[51] Int. Cl.[6] ..... A47L 13/12; A46B 9/04

[52] U.S. Cl. ..... 15/110; 15/167.1; 15/195; 15/205; 15/207.2; 15/DIG. 5; 15/DIG. 6

[58] Field of Search ..... 15/110, 167.1, 15/195, 205, 207.2, DIG. 5, DIG. 6

[56] References Cited

U.S. PATENT DOCUMENTS

| | | | |
|---|---|---|---|
| 1,749,744 | 3/1930 | Thacher | 15/205 |
| 3,072,944 | 1/1963 | Clayton | 15/DIG. 6 |
| 3,103,679 | 9/1963 | Clemens | 15/DIG. 6 |
| 4,288,883 | 9/1981 | Dolinsky | 15/110 |
| 5,249,327 | 10/1993 | Hing | 15/DIG. 5 |
| 5,398,367 | 3/1995 | Lu | 15/DIG. 5 |

*Primary Examiner*—David Scherbel
*Assistant Examiner*—Terrence R. Till
*Attorney, Agent, or Firm*—Veo Peoples, Jr.; J. William Stader; Peoples & Hale

[57] ABSTRACT

The invention is a brush for cleaning and polishing teeth while stimulating the gums. The invention consists of a handle with an integral head. The head has a flat surface with a plurality of recessed sockets. Affixed within the recessed sockets are the stimulator rods surrounded by bristles and polishing rods surrounded by bristles.

4 Claims, 2 Drawing Sheets

BRUSH FOR CLEANING AND POLISHING TEETH WHILE STIMULATING GUMS

BACKGROUND OF INVENTION

1. Field of Invention

This invention relates to the field of brushes, in particular brushes used to clean and polish teeth while simultaneously stimulating gums.

2. Description of Prior Art

There have been continuing attempts to develop devices to improve oral hygiene. Currently there are several devices which are used to limit various affiliations of the teeth and gums. The most common dental device is the conventional toothbrush. It is well established that a toothbrush when used with a toothpaste or dentifrice helps remove plaque and other detrimental microbes. The head of a toothbrush has several variations. The head design can consist of tufts of bristles spaced over the head of the toothbrush. A typical tuft layout consists of 5 to 11 columns by 2 to 4 rows of tufts. The tip of the tufts creates the brushing plane. The may be several different profiles of the brushing plane. The brushing plane may be of equal length, dome shaped, bi-level or rippled. Originally the bristles were made of horse hair, however the conventional material is now nylon. The diameter of a typical bristle ranges from 0.15 to 0.3 mm. Each bristle gives vertical support to the adjacent bristle, and each tuft gives vertical support to an adjacent tuft. Thinner bristles are softer and more resilient. Shorter bristles are stiffer and have less flexibility The type of brushing plane, bristle diameter and bristle length depends on individual preference and brushing style.

Another common dental tool is a tooth polisher. Tooth polishers may be chemical based (such as a polishing paste) or machine based (such as a polishing tool) or a combination of both. The most commonly used method is polishing paste. The pastes contain an abrasive, water, a humectant, a binder and agents for sweetening, flavoring and color. The abrasive is the most critical ingredient in a polishing paste. There are generally three types of abrasives—superfine, fine and course. The characteristics of the abrasive particles are shaped, hardness, body strength, attrition resistance, and particle size. Application factors are the quantity applied, speed of application and pressure of application. During polishing abrasion occurs by the sharp edges of the particle producing microscopic scratches and grooves along the enamel surface. The rate of abrasion is determined by characteristics of the abrasive particle and the way the particles are applied. The most conventional manner of polishing teeth is through the use of the rubber cup polisher which is connected to a handpiece. The handpiece is used to produce rotational speeds which are controlled by the operator. The rubber cup makes rotational movements to remove stain and plaque from the coronal portion of the tooth. This method of polishing is for cosmetic and not for therapeutic value. A polished tooth surface provides less undulated or creviced areas for plaque attachment and production.

Finally, the stimulation of the gum or gingiva is necessary to increase tissue tone, surface epithelium and circulation of blood. Gum stimulation can be achieved by dental floss and the use of an stimulator rod. Typically, a stimulator rod is located on a toothbrush at the end opposite to the bristles.

A major drawback of the existing art is that each of these preventive measures are only achieved by using a separate tool for an each preventive measure. Attempts to create a low cost, simple apparatus which combines the functions of cleaning, polishing of teeth while stimulating the gums have been unsuccessful. While some of the prior art devices have aspects which may achieve a single preventive measure, these devices often act to limit or defeat the other preventive measures.

In U.S. Pat. No. 5,040,260, it is disclosed that "with thermoplastic elsomeric projections it is possible to polish the without the use of a dentifrice"; however, such a practice will deprive the user from the many benefits that dentifrice provides, including fluoride which is not present in well water in rural areas. Other examples of such proposals are disclosed in U.S. Pat. Nos. 5,027,796; 4,115,893; 4,403,623; 4,081,877; 4,128,910; 3,874,084 and 3,359,588.

A combined toothbrush and gum stimulator device is disclosed in U.S. Pat. No. 4,288,883. This device has a double wide head which limits its movement in a longitudinal direction only. This characteristic is not recognized as beneficial by some members of the dental profession, since two of the most popular and recommended toothbrushing techniques (Bass and rotary scrub methods) require circular strokes. In this same patent, the inventor advises "Care must be taken to avoid strong horizontal scrubbing motions, which can cause tooth abrasion and gingival trauma".

Similarly U.S. Pat. No. 1,251,250 (Libby) also possesses an abnormally large brush head limiting the brushing motion a user can achieve. While Libby has stimulator rods present for improving gum tone, the device lacks a means for polishing teeth. A further drawback to the Libby device results because the stimulator rods and bristles are of equal heights. Therefore any dentifrice placed on the brush would limit the ability of the stimulator rods to 'pierce' the dentifrice and stimulate the gums.

U.S. Pat. No. 1,268,544 (Cates) suffers a similar deficiency. The Cates disclosure has small suction cups level with the end of various bristles. Not only is it unlikely that the suction cup would be unable to pierce the dentifrice, it is further likely that the suction cup would collect the dentifrice which would limit the suction cup's ability to obtain a seal around the gum. Finally, the cups on the Cates device would crack and weaken. This would also limit their ability to massage the gums.

U.S. Pat. No. 301,644 (Thompson) also contains bristles and elastic rods of various heights. However, the function of the rods in the Thompson device is to prevent the outer bristles from bending outward and ultimately breaking off. Thompson does provide that the rods or tongues may be of varying height—either above, equal to or below the height of the bristles. The stimulation of the gums and the application of dentifrice is not taught in the Thompson device. Indeed, the use of dentifrice did not become widely practiced until much later. The admission of Thompson that the tongues could be of any height relative to the bristles points up a lack of understanding of the value of a dentifrice and gum stimulation. Finally, Thompson lacks any provision for tooth polishing.

It should also be emphasized that none of the prior art reveals a brush which combines the cleaning of the teeth and stimulation of the gum with a tooth polisher. Accordingly, for these and other reasons gum stimulators and tooth cleaners and polishers have not been adopted into a single program of personal oral hygiene.

OBJECTS OF THE INVENTION

It is an object of the present invention to provide a toothbrush which allows the user to clean and polish the teeth while stimulating the gums.

It is a further object of the present invention to provide a toothbrush which accomplishes several oral hygiene objectives in a single device and during a single use.

It is a further object of the present invention to provide a low cost method to manufacture a toothbrush which combines the cleaning and polishing of teeth and gum stimulation.

SUMMARY OF THE INVENTION

The present invention is an apparatus which overcomes the deficiencies in the prior art. The present invention is a toothbrush which is used cleaning and polishing teeth while stimulating the gums. The toothbrush is designed to accomplish these three tasks in a single action and eliminating the need for multiple tools.

The device consists of a handle and integral head. Attached to flat surface of the head are a plurality of stimulating and cleaning means and a plurality of polishing and cleaning means. These means are affixed by a wedge. The stimulation and cleaning means may consist of a single stimulator rod surrounded by bristles. The stimulator rod projects above the height of the bristles and has a pointed tip. The polishing and cleaning means may consist of a single polishing rod surrounded by bristles. The polishing rod has a flat tip and also projects above the bristles. Because the polishing rod and stimulator rods are taller than the surrounding bristles, these rods will not be limited by the presence of a dentifrice.

DETAILED DESCRIPTION OF THE INVENTION

Figure 1:
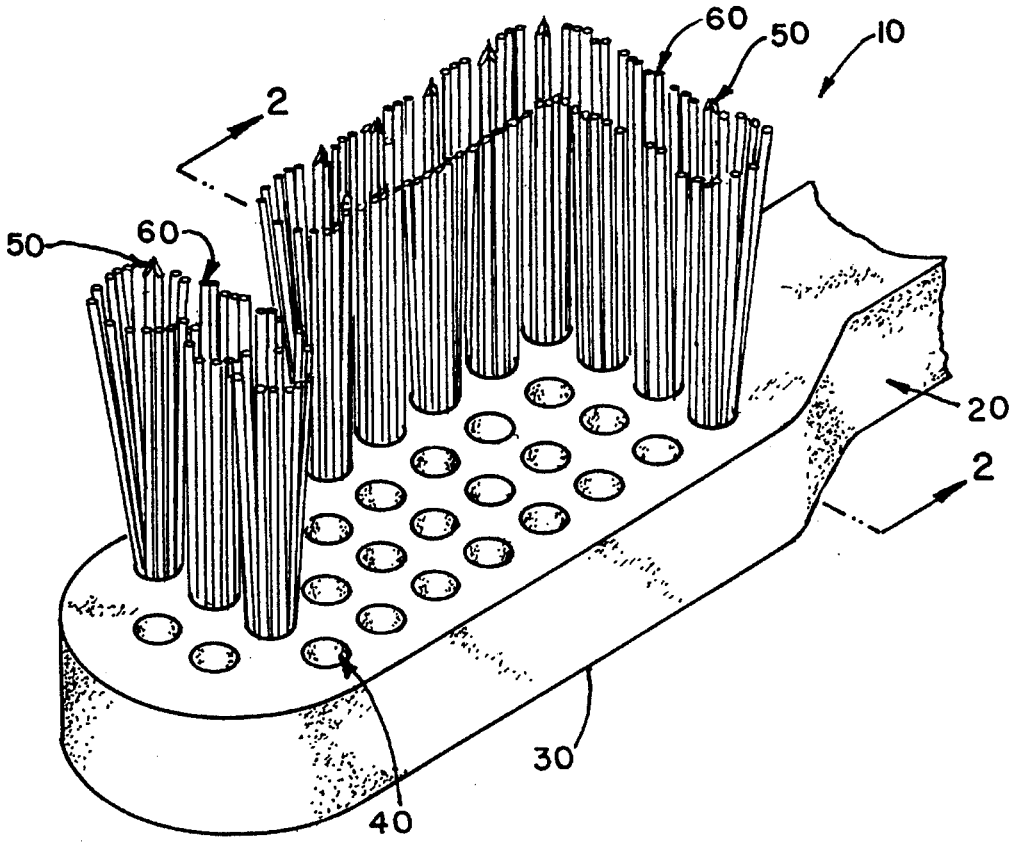
FIG. 1 illustrates the general elements of the present invention.
Figure 2:
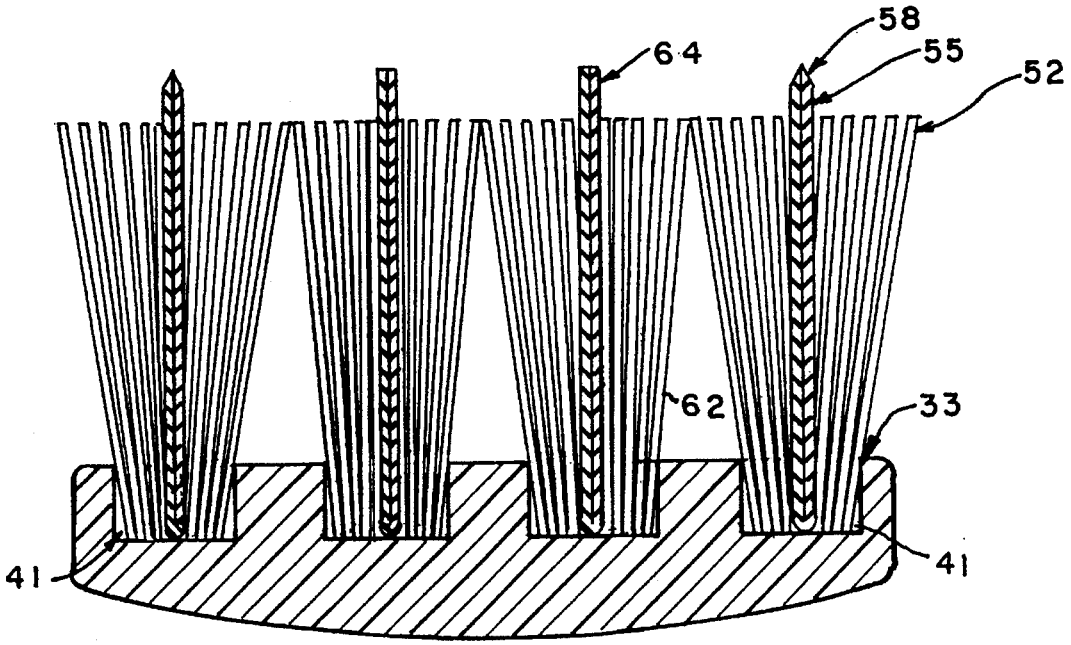
FIG. 2 illustrates a cut-away view of the specific elements of the present invention.

Referring to FIG. 1, it is possible to see the various elements of the present invention. There are five major elements of the present invention. There is a handle (20) and integral head (30). Located on the integral head (30) are the stimulating and cleaning means (50) and the polishing and cleaning means (60). The stimulating and cleaning means (50) and polishing and cleaning means (60) are affixed in a plurality of recessed sockets (40).

The handle (20) is a conventional toothbrush handle. The handle is designed to be comfortably held in the hand of the user. It would be possible to configure the handle to be used in conjunction with a conventional electric toothbrushing apparatus or similar mechanical toothbrush apparatus.

Figure 3:
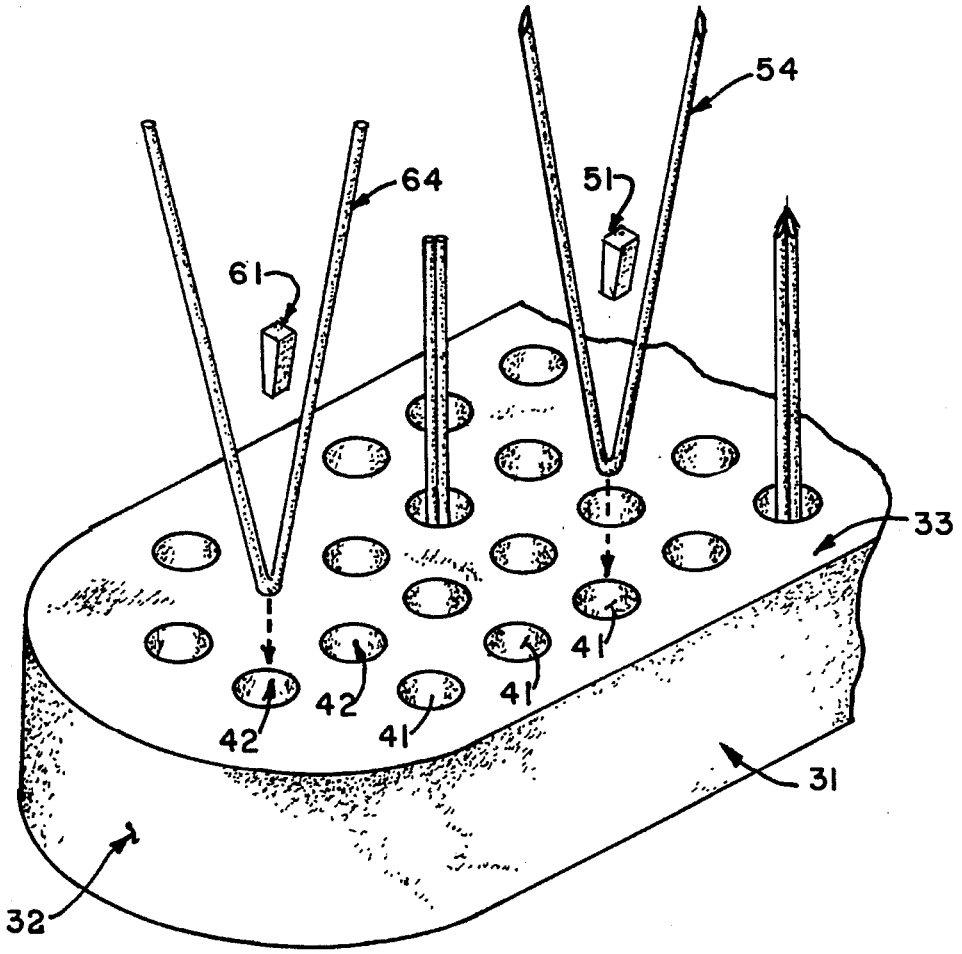
FIG. 3 illustrates a side view of the present invention.

Located at one end of the handle is an integral head (30). There are three important features located on the integral head. Referring to FIG. 3, it is possible to see the length (31) and the width (32) of the integral head. The length and the width define an flat surface (33). It is important to note that the dimensions of the length and width are sufficient to allow the easy insertion of the integral head into the mouth of the user. If the head of the toothbrush is too wide, the user will not be able to brush their teeth in the recommended circular brushing motion. Similarly, if the head is too long, then a portion of the brushes will not be placed into contact with the user's teeth. Typically the width of the head is ½ inch and the length is 1 inch. However, the sizes may vary depending on the user. For instance, the length and width of a child's toothbrush could be considerably smaller. However, the ratio of the length to width will remain the same—typically 2 or 3 to one. The ratio of the length to the width represents a major drawback of the Libby device. In Libby to provide sufficient space on the head for the gum stimulators and bristles the head has been expanded to such a size which limits the ability of user to comfortably insert the head into their mouth. As mentioned above, the length and width define an area called the flat surface (33).

Located within the flat surface (33) are two sets of a plurality of recessed sockets (41 and 42). The first set of recessed sockets (41) are located on the perimeter of the flat surface nearest to the length (31). An identical row is located at the other edge of the flat surface. The second set of recessed sockets (42) is located between the first set (41). The drawings illustrate 4 rows and 8 ½ columns. However, the number and arrangement of either sets of recessed sockets depends on the length (31) and width (32) of the integral head (30). The length and width is determined by the user's individual preferences and manufacturing necessities.

Figure 4:
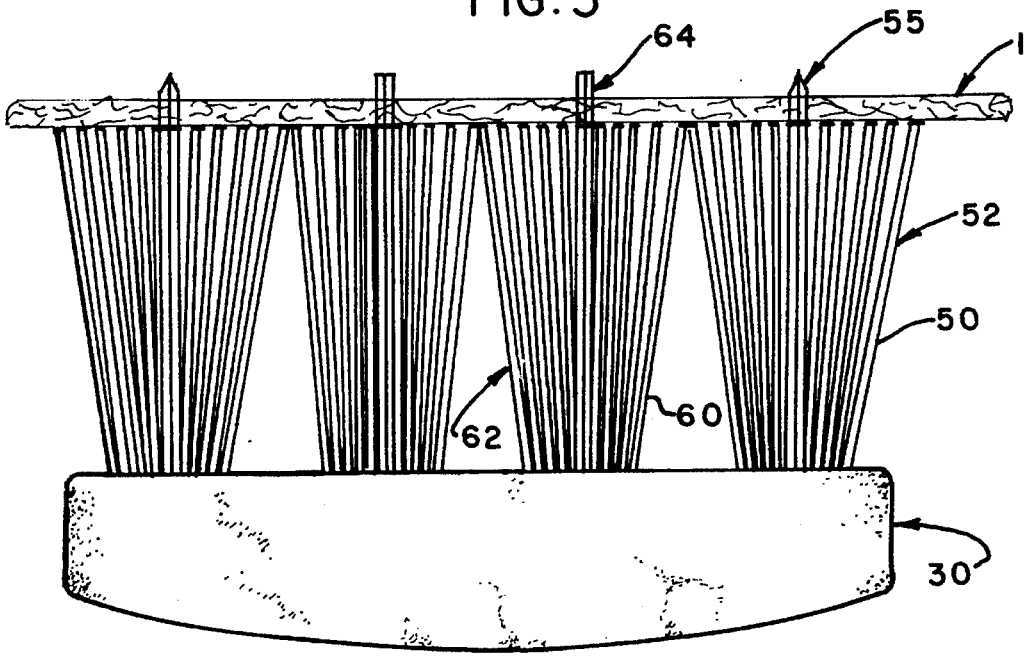
FIG. 4 illustrates a side view with a dentifrice being used with the present invention.

Affixed in the first set of recessed sockets (41) is the stimulating and cleaning means (50). In the preferred embodiment, the stimulating and cleaning means consist of a plurality of bristles (52) surrounding the stimulator rod (55). The bristles and stimulator rod are mounted into the recessed sockets (42) by means of a wedge (51). Typically, the bristles are composed of conventional bristle material such as nylon. The stimulator rod is composed of an elastic material, typically rubber or rubber substitute. The tip of the stimulator rod (58) is angled. The tip angle is approximately 60 degrees. The tip angle is essential to achieving the proper stimulation of a variety of gum regions. The angled tip insures that stimulation is achieved in the gum region between teeth or interproximal gum region. Another critical feature of the stimulating and cleaning means is the necessity that the height of the stimulator rod be greater than the height of the surrounding bristles. FIG. 4 illustrates the importance of the differing stimulator and bristle heights. Because a dentifrice (1) is used to clean the teeth, it is important that the stimulator rod (55) be capable to pierce the layer of dentifrice so as to stimulate the gums. The dentifrice is moved by means of the bristles (52) while the stimulator rods pass through the dentifrice and stimulate the gums. Typically the stimulator rods are approximately ⅛ to 1/16 inches taller than the bristles. Securing the bristles and stimulator rod is a moisture-resistant wedge. A typical diameter of a stimulator rod is 3 to 5 thousands of an inch. A typical diameter of a bristle is 60 thousands of an inch. The precise diameter may be varied to conform with the user's individual brushing style and ability. Larger diameters will result in a stiffer bristle and stimulator rod which would permit a less aggressive brushing motion. Conversely, smaller diameters will allow a softer bristle and stimulator rod.

Affixed in the second set of recessed sockets (42) is the polishing and cleaning means (60). In the preferred embodiment, the polishing and cleaning means consists of a polishing rod (64) surrounded by bristles (62). The bristles and polishing rod are secured within the recessed socket by a moisture-resistant wedge (61). Similar to the stimulating and cleaning means, it is necessary for the polishing rod (64) to be a sufficient height above the bristles (62) to ensure the polishing rod pierces any dentifrice and can polish the tooth. The rod is usually ⅛ to 1/16 inches above the bristles. The diameter of the polishing rod is 3 to 5 thousands of an inch. The diameter of a bristle is 60 thousands of an inch. Similar to the stimulator means, the diameters of the polishing means may vary depending on the user's ability and preference. Another aspect of the polishing rod is the tip. Typically the tip of the polishing rod is flat. The flat surface allows the polishing paste to be more efficiently applied onto the surface of the tooth.

The present invention is operated similar to the conventional toothbrush. Typically, the user will place a dentifrice onto the stimulating & cleaning means (50) and the polishing & cleaning means (60). The user will then place the head of the brush into their mouth and place the dentifrice, stimulating & cleaning means and polishing & cleaning means into contact with a tooth surface. The user then makes the conventional circular brushing motion. Because the stimulator rods (55) and polishing rods (64) are higher than the bristles (52 and 62), they pierce the dentifrice. The polishing rods, with their flat surface, act to polish the tooth surface, while the stimulator rods act to stimulate portions of the gum. The bristles move the dentifrice and clean the teeth.

It will be obvious to those skilled in the art that various changes may be made without departing from the scope of the invention and the invention is not to be considered limited to what is illustrated in the drawings and described in the specification.

What is claimed is:

1. A brush for cleaning and polishing a set of teeth while stimulating gums comprising:

a. a handle;

b. an integral head attached to the handle, said head having a length and a width, which defines a flat surface, said length much greater than the width so as to easily accommodate insertion of the head into a user's mouth;

c. said flat surface having a first and second set of recessed sockets therein, said first set of sockets surrounding the second set of sockets and proximate to the length;

d. a plurality of bristles surrounding an elastic stimulator rod, said stimulator rod having a height greater than a height of said bristle so as to allow a dentifrice to be placed and moved by said bristles while permitting a user's gum to be massaged by the stimulator rod, said bristles and said stimulator rod are secured in the first set of recessed sockets by a wedge; and e. a plurality of bristles surrounding an elastic polishing rod, said polishing rod having a height greater than a height of said bristle so as to allow a dentifrice to be placed and moved by said bristles while permitting a user's tooth to be polished by the polishing rod, said bristles and said polishing rod are secured in the second set of recessed sockets by a wedge.

2. The brush, as defined in claim 1 wherein the stimulator rod has a tip at an acute angle, said angle being 60 degrees.

3. The brush, as defined in claim 2 wherein the bristle has a diameter of 60 thousands of an inch and the stimulator rod and polishing rod have diameters of 4 thousands of an inch.

4. The brush, as defined in claim 2 wherein the height of the stimulator rod and the polishing rod are ⅛ of an inch greater than the bristles.

* * * * *